US012497836B2

(12) United States Patent
Peters et al.

(10) Patent No.: US 12,497,836 B2
(45) Date of Patent: Dec. 16, 2025

(54) STEERING DEVICE, METHOD AND SYSTEM

(71) Applicant: Baker Hughes Oilfield Operations LLC, Houston, TX (US)

(72) Inventors: Volker Peters, Niedersachsen (DE); Andreas Peter, Celle (DE); Christian Fulda, Lower Saxony (DE); Tim Mueller, Burgwedel (DE); Ingo Roders, Seelze (DE); Olaf Gaertner, Isernhagen (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/511,370

(22) Filed: Nov. 16, 2023

(65) Prior Publication Data

US 2024/0159108 A1 May 16, 2024

Related U.S. Application Data

(60) Provisional application No. 63/425,794, filed on Nov. 16, 2022.

(51) Int. Cl.
*E21B 7/06* (2006.01)
*E21B 34/06* (2006.01)

(52) U.S. Cl.
CPC ..... *E21B 7/06* (2013.01); *E21B 34/06* (2013.01); *E21B 2200/02* (2020.05)

(58) Field of Classification Search
CPC ... E21B 7/04; E21B 7/06; E21B 7/064; E21B 7/046
See application file for complete search history.

(56) References Cited

U.S. PATENT DOCUMENTS

| | | | |
|---|---|---|---|
| 2,167,194 | A | 7/1939 | Anderson |
| 4,512,420 | A | 4/1985 | Hayatdavoudi et al. |
| 4,633,958 | A | 1/1987 | Mouton |
| 4,790,394 | A | 12/1988 | Dickinson, III et al. |
| 4,930,586 | A | 6/1990 | Turin et al. |
| 5,074,681 | A | 12/1991 | Turner et al. |
| 5,520,256 | A | 5/1996 | Eddison |

(Continued)

OTHER PUBLICATIONS

Notification of Transmittal of the International Search Report and the Written Opinion of the International Searching Authority, or the Declaration; PCT/2023/080065; Mail Date: Mar. 7, 2024; 8 pages.

(Continued)

*Primary Examiner* — David Carroll
(74) *Attorney, Agent, or Firm* — CANTOR COLBURN LLP

(57) ABSTRACT

A drilling system configured to drill a borehole into a subsurface formation, including a steering device. The steering device is configured to convey a fluid supply through a valve to an outside surface of the steering device, wherein the fluid flow causes a steering force on the steering device. A method for drilling a borehole into a subsurface formation, including disposing a steering device in the borehole, rotating the steering device, urging a fluid to flow through a valve of the steering device to an outside surface of the steering device, wherein the fluid flow causes a steering force on the steering device.

23 Claims, 6 Drawing Sheets

(56) References Cited

U.S. PATENT DOCUMENTS

| | | | | |
|---|---|---|---|---|
| 5,542,482 | A | 8/1996 | Eddison | |
| 5,967,244 | A | 10/1999 | Arfele | |
| 6,581,699 | B1 | 6/2003 | Chen et al. | |
| 8,302,703 | B2 | 11/2012 | Rolovic | |
| 9,464,482 | B1 * | 10/2016 | Bargach | E21B 44/005 |
| 10,041,302 | B2 | 8/2018 | Blange et al. | |
| 10,100,627 | B2 | 10/2018 | Blange et al. | |
| 10,151,150 | B2 | 12/2018 | Blange et al. | |
| 11,168,523 | B2 | 11/2021 | McClure et al. | |
| 11,280,182 | B2 | 3/2022 | Dwars et al. | |
| 2007/0221409 | A1 * | 9/2007 | Hall | E21B 4/14 175/73 |
| 2007/0242565 | A1 * | 10/2007 | Hall | E21B 7/24 175/48 |
| 2007/0256865 | A1 | 11/2007 | Cruickshank | |
| 2009/0133931 | A1 | 5/2009 | Rolovic | |
| 2010/0116551 | A1 | 5/2010 | Southard et al. | |
| 2011/0139508 | A1 * | 6/2011 | Haugvaldstad | E21B 7/06 175/50 |
| 2011/0139512 | A1 * | 6/2011 | Haugvaldstad | F15B 15/08 60/407 |
| 2012/0160565 | A1 * | 6/2012 | Downton | E21B 7/062 175/73 |
| 2016/0084004 | A1 | 3/2016 | Prill et al. | |
| 2017/0234071 | A1 | 8/2017 | Spatz et al. | |
| 2018/0016844 | A1 | 1/2018 | Peters | |
| 2018/0016845 | A1 | 1/2018 | Peters | |
| 2020/0056451 | A1 | 2/2020 | Chambers et al. | |
| 2020/0199970 | A1 | 6/2020 | Odegbami | |
| 2020/0362637 | A1 | 11/2020 | Peters | |
| 2021/0062585 | A1 | 3/2021 | Nanayakkara et al. | |
| 2023/0366271 | A1 * | 11/2023 | Minett-Smith | E21B 7/065 |
| 2024/0159109 | A1 * | 5/2024 | Peters | E21B 7/065 |
| 2024/0159111 | A1 | 5/2024 | Peters et al. | |

OTHER PUBLICATIONS

Notification of Transmittal of the International Search Report and the Written Opinion of the International Searching Authority, or the Declaration; PCT/US2023/080067; mail date: Mar. 7, 2024: 9 pages.

Notification of Transmittal of the International Search Report and the Written Opinion of the International Searching Authority, or the Declaration; PCT/US2023/080075; Mail date: Feb. 29, 2024; 9 pages.

* cited by examiner

STEERING DEVICE, METHOD AND SYSTEM

CROSS REFERENCE TO RELATED APPLICATIONS

This application claims the benefit of an earlier filing date from U.S. Provisional Application Ser. No. 63/425,794 filed Nov. 16, 2022, the entire disclosure of which is incorporated herein by reference.

BACKGROUND

In industries where access to subsurface reservoirs is provided through boreholes, it is sometimes desirable to have the ability to steer strings running in boreholes being drilled or even in preexisting boreholes to assist strings moving past deviations in the trajectory of the borehole. Bent subs are common means used to cause steering of a string creating or running in a borehole. While bent subs and other means for steering have been used with reasonable success, the art is always receptive to improvements in efficiency.

SUMMARY

An embodiment of a drilling system configured to drill a borehole into a subsurface formation, the drilling system including a steering device configured to be disposed in the borehole, the steering device rotatable within the borehole about a rotational axis of the steering device, the steering device configured to convey a fluid supply, a valve disposed in the steering device, at least a portion of the valve rotatable with the steering device about the rotational axis, the valve configured to allow fluid to flow through the valve from the fluid supply to an outside surface of the steering device, wherein the fluid flow causes a steering force on the steering device, the steering force configured to change a direction of drilling the borehole, and an actuator operably connected to the steering device and operatively connected to the valve, the actuator configured to operate the valve to change the fluid flow through the valve.

An embodiment of a method for drilling a borehole into a subsurface formation, the method including disposing a steering device in the borehole, rotating the steering device within the borehole about a rotational axis, wherein the steering device configured to convey a fluid supply, wherein the steering device comprises a valve rotating with the steering device, and wherein the steering device further comprises an actuator operatively connected to the valve, urging a fluid to flow through the valve from the fluid supply to an outside surface of the steering device, wherein the fluid flow causes a steering force on the steering device, the steering force configured to change a direction of drilling the borehole, operating the valve by the actuator to change the fluid flow through the valve.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
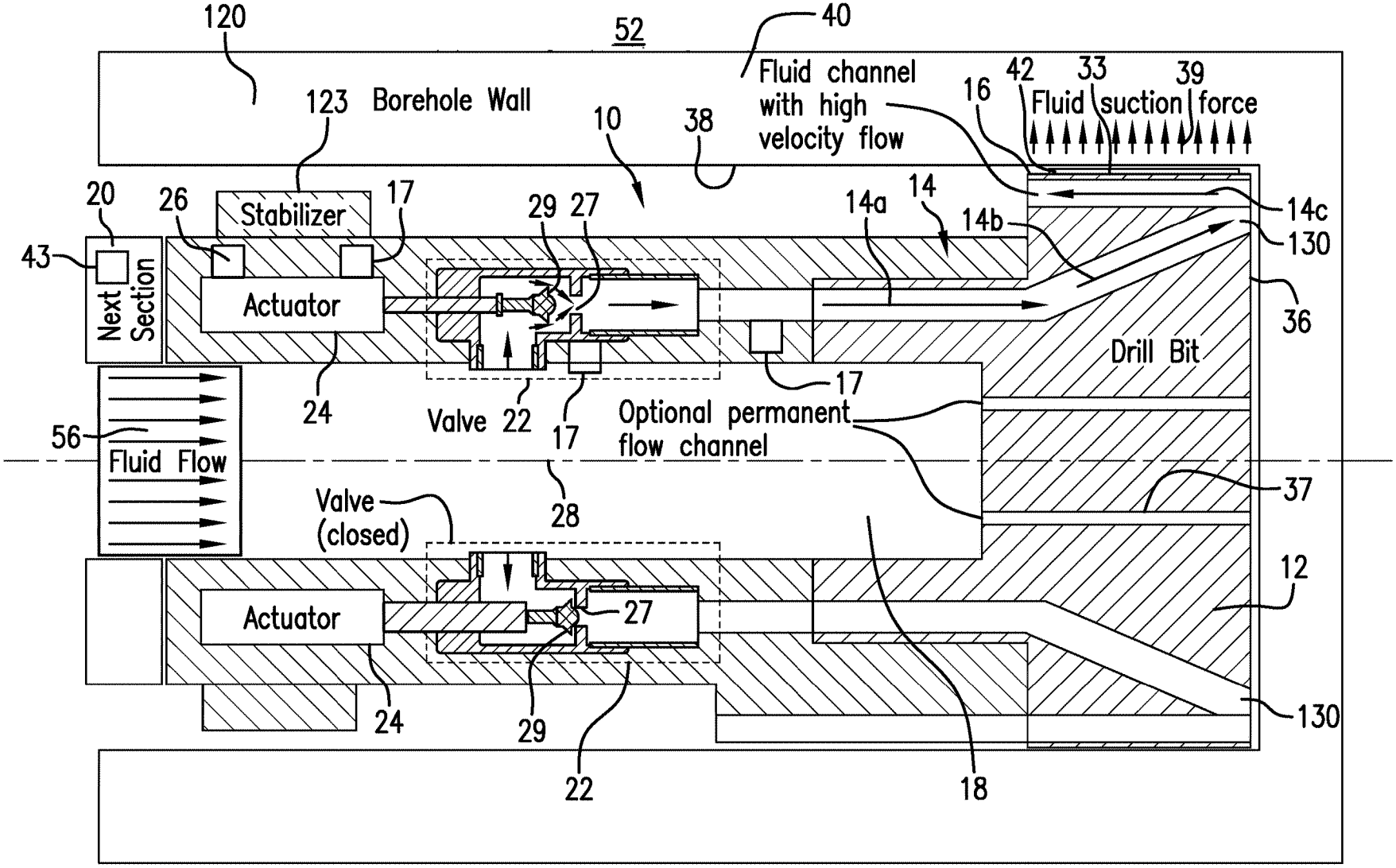
FIG. 1 is a cross sectional view of a steering device as disclosed herein.

Referring to FIG. 1, a steering device 10 is illustrated in cross section. The device includes a drill bit 12 configured to cut and/or disintegrate a subsurface formation, such as subsurface formation 52 in FIG. 4, and having a flow passage 14 therein. Flow passage 14 may include one or more segments, such as connected segments to allow fluid flow through the segments and from one segment to the other segments. Three segments (14*a*, 14*b*, 14*c*) of flow passage 14 are illustrated in FIG. 1. These provide for a fluid path through flow passage 14 from a fluid supply 18 (which may be a conveyance or a source) of steering device 10 to an outside surface 16 of the drill bit 12. It is noted that the fluid supply 18 may be defined by an inside diameter (ID) of the steering device 10 that is fluidly connected to an ID of a string 20 (for example, drill string 20) capable of supplying fluid 56 (e.g., drilling fluid, also known as drilling mud or mud) to the steering device 10 but also may use control lines to supply fluid 56 to other devices, such as one or more valves 22. Optionally, one or more additional permanent flow channels 37 provide continuous fluid flow through the drill bit 12 in addition to the fluid flow through flow passage 14 via valve(s) 22. Permanent flow channels 37 in this context means that flow channels 37 are not connected to a valve that selectively or temporarily changes, reduces, or prevents fluid flow through permanent flow channels 37 even when pressure difference between pressure in fluid supply 18 and pressure at the outside surface 16 of drill bit 12 is constant. Additional fluid flow through additional permanent flow channels 37 allows to cool and lubricate drill bit 12 even when all valves 22 are closed and/or when the fluid flow through valve(s) 22 is not sufficient. Drill bit 12 and steering device 10 are threadedly connected and rotate at the same speed when in operation. Flow passage 14 and valve 22 rotate with steering device 10. One or more stabilizer(s) 123 may be installed on steering device 10 or string 20 for stabilizing and guiding steering device 10/string 20 within borehole 40.

Valve 22, selectively operable by an actuator 24, is disposed in a fluid path from the fluid supply 18 to the flow passage 14. Valve 22 may be a rotary valve or a reciprocating valve in embodiments. The valve 22 is actuatable by the actuator 24 through electric, mechanical, hydraulic or other means in a selective way that is controlled by a controller 26 operatively connected to the actuator 24. The controller 26 may be in or on the steering device 10 and, optionally, actuator 24 and/or controller 26 rotate as well with the steering device 10. Alternatively, controller 26 may be located remotely either downhole or at the earth's surface 54 (cf. FIG. 4). Controller 26 may be hardwired to actuator 24 or wirelessly connected thereto. It is to be understood that more than one valve may be controlled by one actuator in embodiments. Controller 26 may be configured to control one or more actuators 24 and/or valves 22, individually. For example, controller 26 may be configured to control a first and a second actuator 24 and/or a first and a second valve 22 to allow a greater fluid flow through the first valve compared to the second valve. In some modes of operation, the controller 26 is configured to actuate the valve 22 in a way that causes fluid 56 to flow through flow passage 14 only when that passage is at or near a particular azimuthal direction of the steering device 10 about a rotational axis 28 thereof. For example, controller 26 may be connected to one or more directional sensors 43 internal or external of steering device 10 (e.g., in string 20), that provide information of the rotational positions (e.g., the rotational azimuth about the rotational axis 28 of steering device 10) of steering device 10. Based on that information, the controller 26 operates the one or more valves 22. Controller 26 may, for example, operate valve 22 to increase fluid flow only when steering device 10 is at a preselected rotational position interval (i.e., when the rotational azimuth of steering device 10 about the rotational axis 28 is within a preselected range of values). Alternatively, directional sensor 43 provides a rotational velocity of steering device 10 and controller 26 operates valve 22 in a periodic way where the periodicity is related to the rotational velocity provided by directional sensor 43. For example, in some modes of operation such as when rotational velocity of steering device 10 is constant, the controller 26 is configured to actuate the valve 22 in a periodic way that causes fluid 56 to flow through flow passage 14 only when that passage is at or near a particular azimuthal direction of the steering device 10 about the rotational axis 28 thereof. By so actuating the valve 22, the fluid 56 flowing in segment 14*c*, which may be a junk slot or a channel in the drill bit 12 created for the purpose of conveying fluid 56, will cause a steering force on the steering device 10. This is due to the creation of a velocity fluid flow through segment 14*c* that causes a Bernoulli effect of a lower pressure resulting in a Bernoulli suction force that draws the steering device 10 in the direction of that fluid flow thereby acting as a steering force on the steering device 10 configured to change the direction of drilling the borehole 40 to steer steering device 10 including drill bit 12 while drilling progresses. In this way, the created Bernoulli suction force stays geostationary. Geostationary in this context means that the direction of the Bernoulli suction force is directed into the same azimuthal direction relative to a fixed reference, such as the formation, the earth's magnetic field and/or the direction of gravity. That is, the Bernoulli suction force does not change its azimuthal direction about the rotational axis 28. In embodiments, the Bernoulli suction force stays geostationary while the steering device 10 rotates. The geostationary nature of the Bernoulli suction force in some embodiments remains for a predefined time interval or a predefined number of rotations. For example, the Bernoulli suction force will remain geostationary while the steering device 10 rotates for at least ten rotations, for at least 20 rotations, or even for at least 50 rotations of the steering device 10.

In FIG. 1, valve 22 is shown as a reciprocating valve (e.g., poppet valve or mushroom valve) where actuator 24 causes a reciprocating movement of an obstruction member (e.g., plug) 29 to press it onto or release it from an opening (e.g., seat) 27 to regulate flow of fluid 56 through flow passage 14. Alternatively, actuator 24 may also cause a rotating member (not shown) in operative connection with obstruction member 29 to rotate and to cause the reciprocating movement of obstruction member 29 (for example when the rotating member is a cam shaft that is rotated by actuator 24 and is in operative connection with obstruction member 29 wherein the rotation of the cam shaft causes the reciprocating movement of obstruction member 29). In another example, valve 22 may be a rotary valve in which the rotation of a passage (e.g., a passage included in a transverse plug) connects or disconnects fluid supply 18 with flow passage 14 to regulate the flow of fluid 56 through the attached flow passage 14. For a rotary valve, the obstruction member 29 may be rotated relative to the opening 27. The rotation of the obstruction member 29 relative to the opening 27 may be at the same rotational speed as the rotation of steering device 10 or at a different rotational speed.

Junk slots or channels that are adjacent to other junk slots or channels are at least partially hydraulically isolated from adjacent junk slots or channels to enhance the fluid flow that produces the Bernoulli effect. This is manageable by structure, such as a flow barrier 33 between adjacent junk slots or channels (which may be a cutting arm of the drill bit 12 or a dedicated structure, for example) that is within a certain distance to surface 38 of a borehole 40. The distance of surface 38 of borehole 40 to flow barrier 33 is smaller than the distance of the outer surface of the channel to the surface 38 of borehole 40. For example, the distance of the flow barrier 33 to the inside surface 38 of a borehole 40 may be about 10 mm or smaller or even 5 mm or smaller when the steering device 10 is in use. That is, the diameter of flow barrier 33 is 20 mm or even 10 mm smaller than the diameter of the outermost cutting structure of the drill bit 12. Further, it is contemplated to configure the flow barrier 33 with an extendible element 42 that will reach toward the surface 38 during use to enhance hydraulic isolation between adjacent junk slots or channels and then easily collapse so that drag is not created on the drill bit 12.

Figure 2:
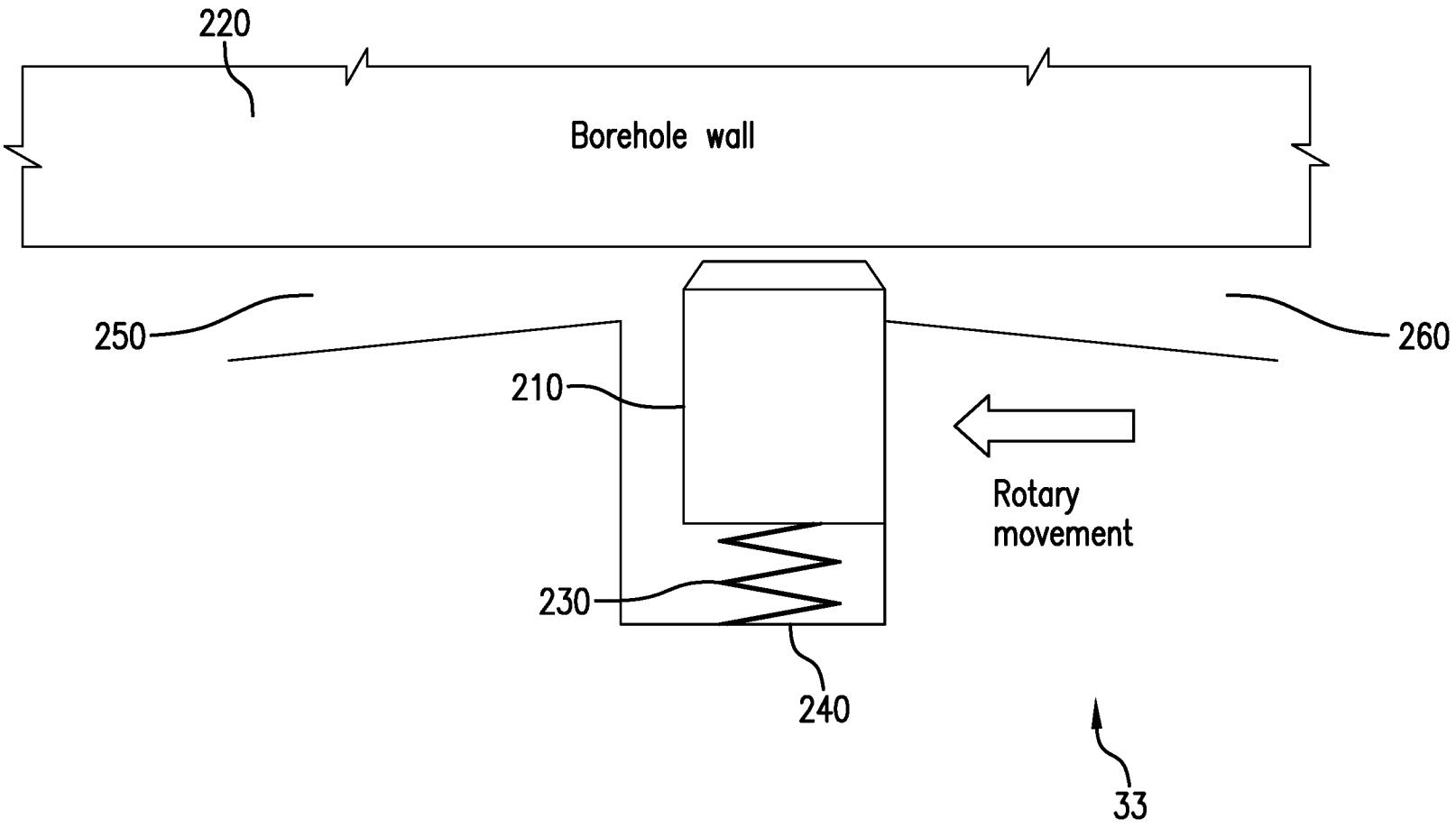
FIG. 2 is an embodiment of a flow barrier.

Turning now to FIG. 2, the flow barrier 33 may include an apex seal 210 (cf. FIG. 2), for example, in a groove 240 (such as an elongated groove) along the junk slot or between junk slots. The flow barrier 33 including the apex seal 210 may be substantially parallel to the rotational axis 28 of steering device 10 or may be arranged at an angle with respect to the rotational axis 28 of steering device 10. Such apex seal 210 may be energized by biasing members 230, which may include active elements such as actuators and/or which may include passive elements such as (weak) springs in embodiments (for example, springs with a relatively low stiffness that are configured to expand and engage with the borehole wall 220 at relatively low force to keep the rubbing and friction force at a relatively low level while still inhibiting or reducing fluid flow therepast). In some cases, the shape of the radial outside surface 16 of the drill bit 12 may not exactly match the shape of the inner surface of the borehole wall 220. In these cases, there may be fluid filled spaces or one or more cavities between drill bit 12/steering device 10 and borehole wall 220, such as a first cavity 250 and/or a second cavity 260. The flow barrier 33 or apex seal 210 has the effect to limit or reduce the fluid connection between adjacent first and second cavity 250/260 or junk slots, thus fluid flow between first and second cavity 250/260 and thereby increasing the sealing effect between the cavities or junk slots. Reducing the fluid connection between adjacent first and second cavity 250/260 or junk slots further limits the area of relatively high flow to a separated azimuth range that is defined by the first cavity 250 or the second cavity 260, which creates the Bernoulli suction forces upon the low pressure area and adjacent cavities or junk slots. If the Bernoulli suction force is creating the desired lateral offset towards the borehole into direction of the low pressure area, the apex seal 210 can retract against the weak springs accordingly. Springs are sized to maintain extended position of the apex seal 210. It is noted that the extendible element 42 may be beneficial but is not required to take advantage of this disclosure. In contrast, some concepts disclosed here are suited to provide a steering device for downhole that has no extendible part, for example no extendible part in contact with the borehole wall 120.

Fluid flow in flow passage 14 may exit a portion of the flow passage 14 at a flow exit 130 (which may be at an end of segment 14*b* or at an end of segment 14*c*), to the outside surface 16 of the drill bit 12, at a face 36 of the drill bit 12 or at a radial side of the drill bit 12. In some embodiments (not shown), the flow direction at the flow exit 130 out of channel 14 (e.g. at the ends of segment 14*b* and/or segment 14*c*) is in an uphole direction of the drill bit 12, which is also the downstream direction for the flowing fluid 56 (drilling mud, for example) returning to surface. For example, a flow exit 130 that is on the radial outside surface 16 of the drill bit 12 rather than on the drill bit face 36, creates a flow with a flow direction in an uphole direction of the drill bit 12. When steering is desired, flow through flow passage 14 is permitted (by actuator 24 and valve 22) mainly or even only near or at a selected azimuthal position. Fluid flow along the outside surface 16 of the drill bit 12 that comes from flow passage 14, causes a radial Bernoulli suction force (indicated by arrows 39) and a steering force in the same azimuthal direction.

Where more than one Bernoulli subsystem (flow passage 14, valve 22 and actuator 24) is included, the steering force may be created more than once per revolution of the steering device 10 by cycling sequential valves 22 at the appropriate time and appropriate azimuthal position of flow passage segments 14*b*/14*c* such that each valve provides fluid flow if and when its associated flow passage segments 14*b*/14*c* are at the desired azimuthal position. When none of the flow passage segments 14*b*/14*c* is at the selected azimuthal position, valves 22 may be actuated to reduce or prevent fluid flow through their associated flow passage segments 14*b*/14*c* only if and when associated flow passage segments 14*b*/14*c* are at the selected azimuthal position. FIG. 1 illustrates two Bernoulli subsystems though more are contemplated. At least three Bernoulli subsystems is contemplated in one desirable embodiment. In each Bernoulli subsystem, the actuators 24 may be individually addressable to cause repositioning of the associated valve 22 allowing for control of: 1) when a Bernoulli effect is created pursuant to fluid flow in the associated flow passage 14; and 2) the magnitude of the fluid flow to create a larger (greater Bernoulli effect) or smaller (lesser Bernoulli effect) steering force and radius of curvature of the drilled borehole 40. In embodiments, actuators 24 are operable at at least 3 Hertz, though faster and slower rates are also contemplated for various needs. It will also be appreciated that if valve(s) 22 are not operated during one or more rotations of steering device 10 and hence at all azimuthal positions of steering device 10 (for example, if valve(s) 22 are open or closed or at a fixed position between fully open or fully closed during one or more rotations of steering device 10), then the steering force that is caused by the fluid 56 that exits flow exit 130 will also rotate with steering device 10 and thus will cancel out over one or more rotations of steering device 10 or becomes distributed about 360 degrees of the steering device 10 and cancels out thus providing no steering effect to steering device 10 and/or drill bit 12. Thus, when valve(s) 22 are not operated during one or more rotations of steering device 10, the steering device 10 will drill in a natural direction, such as in a straight or tangential direction thus creating a straight or tangential section of borehole 40 (such as straight or tangential section 93 of borehole 40, cf. FIG. 4). A similar effect is achieved when controller 26 operates the one or more valves 22 in a periodic way, wherein the period of the valve operation is not a multiple of the revolution period of rotation of the steering device 10. That is, when controller 26 operates the one or more valves 22 in a periodic way, wherein the period of the valve operation is not a multiple of the revolution period of rotation of the steering device 10 during one or more rotations of steering device 10, then the steering force that is caused by the fluid 56 that exits flow exit 130 will cancel out over one or more rotations of steering device 10 or becomes distributed about 360 degrees of the steering device 10 and cancels out thus providing no steering effect to steering device 10 and/or drill bit 12. Thus, when controller 26 operates the one or more valves 22 in a periodic way, wherein the period of the valve operation is not a multiple of the revolution period of rotation of the steering device 10 during one or more rotations of steering device 10, the steering device 10 will drill in a natural direction, such as in a straight or tangential direction thus creating a straight or tangential section of borehole 40 (such as straight or tangential section 99 of borehole 40, cf. FIG. 4). In one embodiment, valve(s) 22 will be randomly operated (e.g., randomly operated opened and closed) during one or more rotations of steering device 10 so that the steering force that is caused by the fluid 56 that exits flow exit 130 will cancel out over one or more rotations of steering device 10 or becomes distributed about 360 degrees of the steering device 10 and cancels out thus providing no steering effect to steering device 10 and/or drill bit 12 to drill in a natural direction, such as in a straight or tangential direction thus creating a straight or tangential section of borehole 40 (such as straight or tangential section 99 of borehole 40, cf. FIG. 4). Closing all valves 22 may also be helpful to remove any obstruction in permanent flow channels 37 that may occur during operation of steering device 10 by solids in fluid 56, for example.

In one or more embodiments, actuator 24 is also activatable to position the valve 22 at other than fully open or fully closed. The valve 22 may in fact be positioned anywhere between (and including) fully open and fully closed, which allows for control of the degree the Bernoulli suction force and/or of steering force is created in the steering device 10. The Bernoulli suction force can thus be adjustable to create a particular magnitude of steering response that is changeable on demand. Specifically, if a smaller volume of fluid 56 is released through flow passage 14, by opening the valve 22 only part way, a smaller Bernoulli suction force is created and therefore a smaller steering force. The greater the fluid flow through flow passage 14 the greater the Bernoulli effect and hence the greater the steering force induced. In some embodiments, a desired steering parameter, such as a desired steering force, Bernoulli suction force, flow of fluid 56, radius of curvature of the drilled borehole 40, or similar may be determined and communicated to controller 26. Communication of the desired steering parameter to controller 26 may be done before steering device 10 operates downhole or while drilling progresses steering device 10 is in operation (e.g., in real time). Controller 26 uses the desired steering parameter to adjust the one or more valve(s) 22, accordingly.

The actuator 24, in embodiments, may include a position feedback configuration that may comprise a sensor 17 operably connected to the actuator 24 or valve 22 or even to flow passage 14. Sensor 17 may provide data of the relative position of valve 22, or fluid flow through flow passage 14 to controller 26 to adjust valve 22 by actuator 24 until the measured data by sensor 17 is close enough to a predetermined value (e.g., until the difference between the measured data by sensor 17 and the predetermined value is smaller than a predetermined threshold). For example, when the sensor is a flow meter, it can be used to measure the fluid flow in flow passage 14, thereby creating fluid flow data and the fluid flow data can be used by controller 26 to adjust valve 22 by actuator 24 until the desired fluid flow is measured by sensor 17. The position feedback configuration reports position of the Bernoulli subsystem to the controller 26, for example in real time. In other embodiments, the actuator 24 may be or may employ a resolver motor so that motor position may be known by the controller 24.

Figure 3:
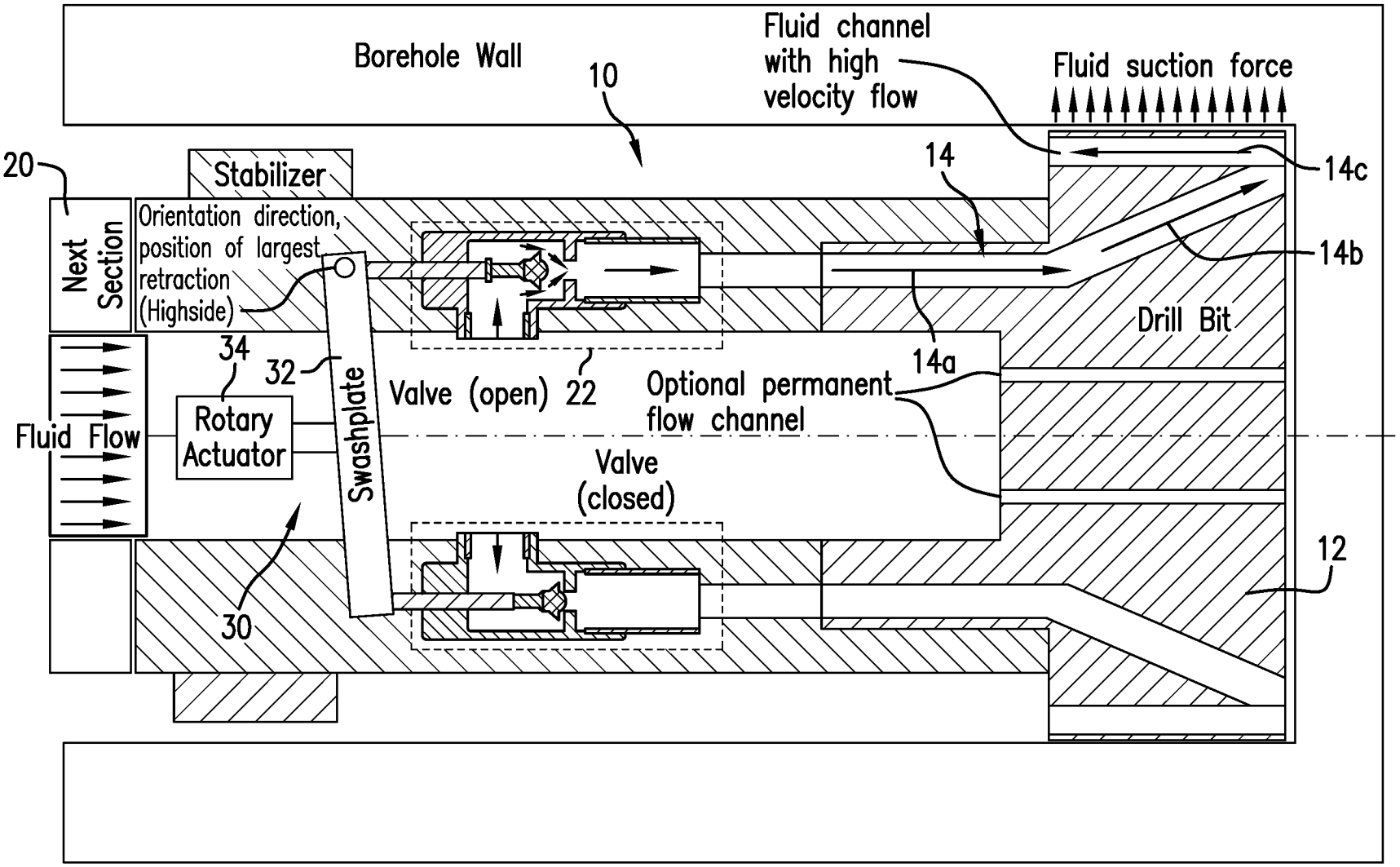
FIG. 3 is a view similar to FIG. 1 but having a single actuator.

In some embodiments, valve(s) 22 rotate with the steering device 10 and in other embodiments, the actuator(s) 24 also rotate with the steering device 10. In yet other embodiments, referring to FIG. 3, a single actuator 30 is configured to operate more than one valve 22. Single actuator 30 may operate one or more valves 22 and/or all valves 22 in the steering device 10. FIG. 3 illustrates one iteration of steering device 10 wherein a single actuator 30 operates a plurality of valves 22 and does so by a swashplate 32 attached to a motor 34. The swashplate 32 may be rotated to ensure the created Bernoulli suction force stays geostationary. Geostationary in this context means that the direction of the Bernoulli suction force is directed into the same azimuthal direction relative to a fixed reference, such as the formation, the earth's magnetic field and/or the direction of gravity. That is, the Bernoulli suction force does not change its azimuthal direction about the rotational axis 28 of steering device 10. In embodiments, the swashplate 32 will remain geostationary while the steering device 10 rotates. The geostationary nature of the Bernoulli suction force in some embodiments remains for a predefined time interval or a predefined number of rotations. For example, the swashplate 32 will remain geostationary while the steering device 10 rotates for at least ten rotations, for at least 20 rotations or even for at least 50 rotations of the steering device 10. Motor 34 may be an electric motor, a hydraulic motor, etc.

Figure 1A:
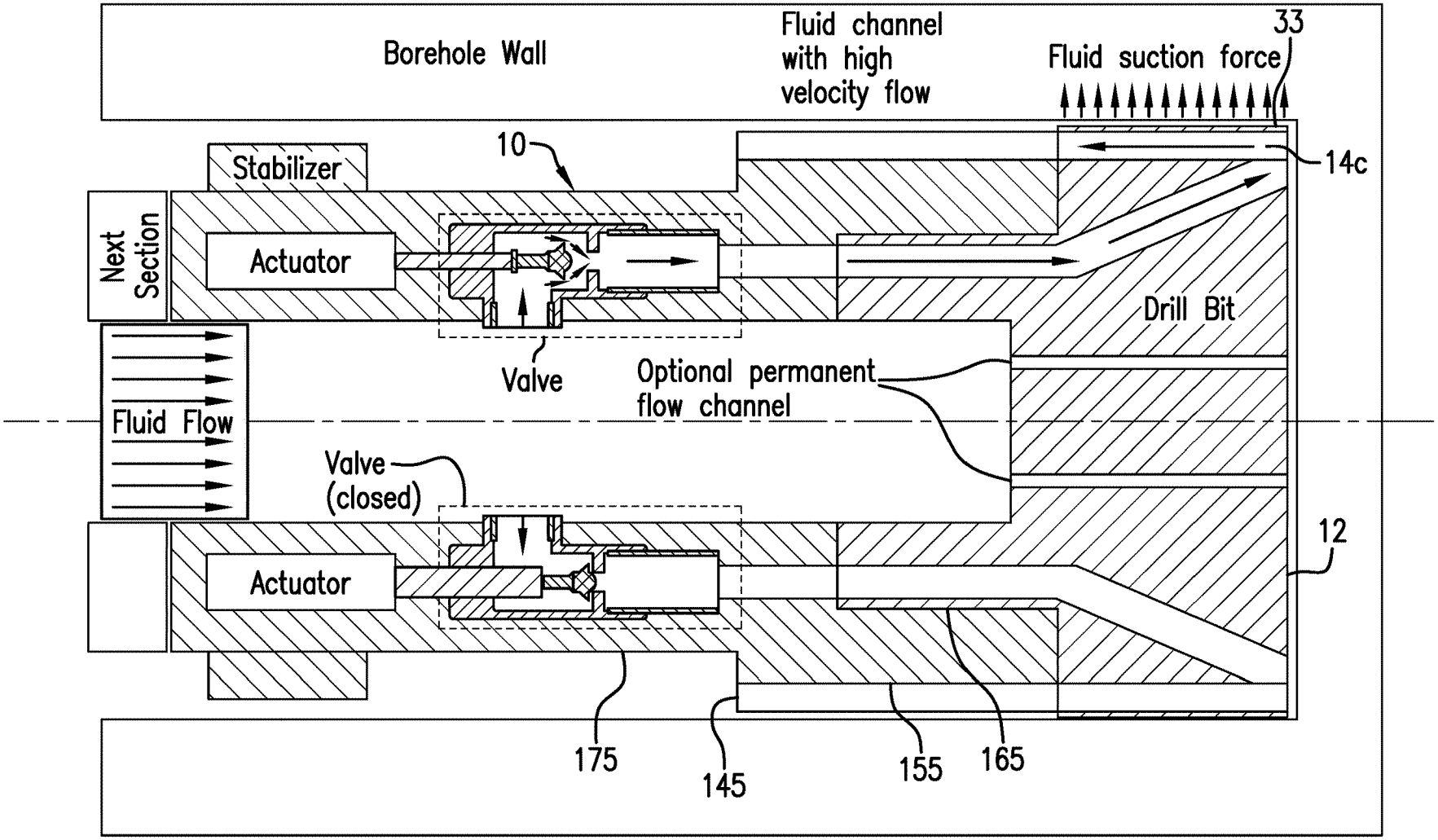
FIG. 1A is an alternative embodiment of the steering device as disclosed herein.

FIG. 1A shows an alternate embodiment that includes one or more channels 145 machined into the steering device 10 (for example, by milling or by welding, brazing, or screwing additional material onto the OD of the steering device 10), and a timed thread connection 165 between the drill bit 12 and the steering device 10. The timed thread connection 165 ensures that segments 14*c*, which may be a junk slot or a channel in the drill bit 12, are aligned to the one or more channels 145 on the steering device 10 so that fluid flowing through segment 14*c* will also flow through channel 145. Advantageously, the one or more channels 145 may be machined into a portion 155 of the steering device 10 that is larger than an adjacent portion 175. For example, portion 155 may have an outer diameter that is larger than the outer diameter of adjacent portion 175. The one or more channels 145 provide additional flow channels behind the drill bit 12. The one or more channels 145 increase the active area of lower pressure, resulting in a higher Bernoulli suction force and steering force of steering device 10 and drill bit 12.

Figure 1B:
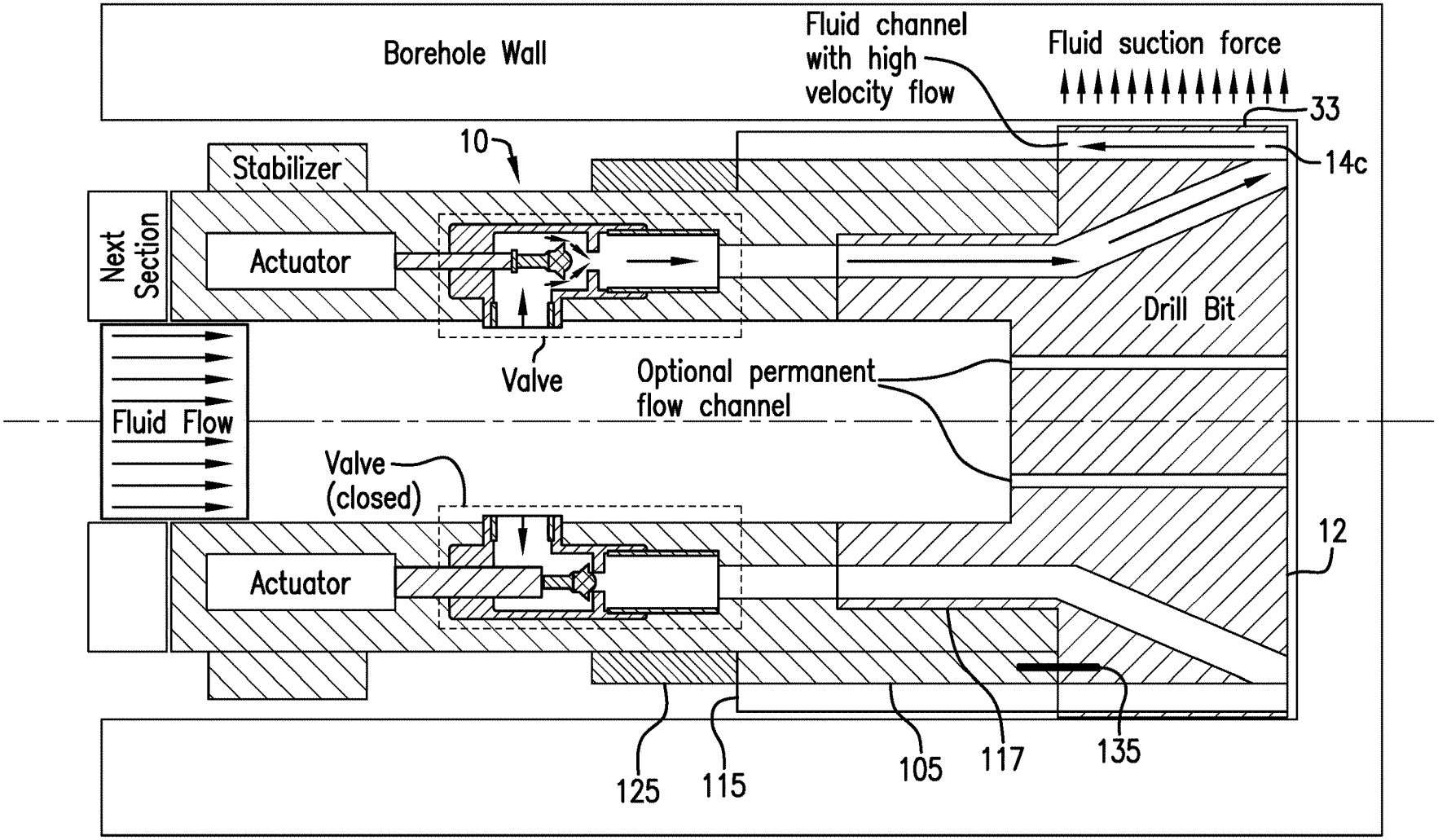
FIG. 1B is an alternative embodiment of the steering device as disclosed herein.

FIG. 1B shows another alternate embodiment, where one or more flow channels 115 are machined into a sleeve 105 that is mounted on the outer diameter of the steering device 10. The sleeve 105 may be fixed by a retaining feature 125, such as a retaining sleeve, for example a threaded retaining sleeve. Sleeve 105 can be aligned to drill bit 12 so that segments 14*c*, which may be a junk slot or a channel in the drill bit 12, are aligned to the one or more channels 115 in sleeve 105, so that fluid flowing through segment 14*c* will also flow through channel 115. The alignment between segment 14*c* and channel 115 may be secured by a rotational locking feature 135 (e.g., a locking key, a pin, or the shape of the mating surfaces of drill bit 12 and sleeve 105) which allows the use of a standard, not-timed thread connection 117 between drill bit 12 and steering device 10. The one or more channels 115 provide additional flow channels behind the drill bit 12. The one or more channels 115 increase the active area of lower pressure, resulting in a higher Bernoulli suction force and steering force of steering device 10 and drill bit 12.

Portion 155 in FIG. 1A and sleeve 105 in FIG. 1B may provide additional mounting space for electronics or sensors or one or more flow barriers 33, such as a sealing. The one or more flow barriers 33 may be provided by extendible element 42 and/or by an additional fluid flow, introduced in addition to fluid flow through segments 14*c*, channels 145, and/or channels 115 and directed and configured to reduce or prevent fluid exchange between channels segments 14*c*, channels 145, and/or channels 115. Flow barriers 33 may support the development of sufficient Bernoulli suction forces in case of larger distance between outside surface 16 of drill bit 12 and/or steering device 10 and inside surface 38 of borehole 40. They can thereby ensure that sufficient steering force is available for pushing drill bit 12 into the desired direction.

In some embodiments, the one or more valves 22 may be interacting to control the fluid flow in the specific segments 14*b*/14*c* (e.g., interacting by controller 26). For example, if three or more valves 22 are used, such as a first, a second, and a third valve, the fluid flow through one of the first, the second, and the third valve may be adjusted based on the fluid flow through the other two of the first, the second, and the third valve. For example, in a particular rotational position of steering device 10, the first valve may allow a first fluid flow, the second valve may allow a second fluid flow, and the third valve may allow a third fluid flow. In this example, one or more of the first, the second, and the third fluid flows may be zero. The first fluid flow may be adjusted by the first valve based on the second and the third fluid flow, the second fluid flow may be adjusted by the second valve based on the first and the third fluid flow, and/or the third fluid flow may be adjusted by the third valve based on the first and the second fluid flow. Accordingly, the first, the second, and the third fluid flow may be different and may vary over time. Alternatively, or in addition, the fluid flow through one of the one or more valves 22 may be adjusted individually and independently based on the downhole pressure and/or the total available fluid flow through supply 18 of steering device 10. In addition, one or more of the valves 22 may be operated to compensate disturbances in the steering force, for example, by systematic amplification or attenuation of the steering forces or Bernoulli suction forces.

Figure 4:
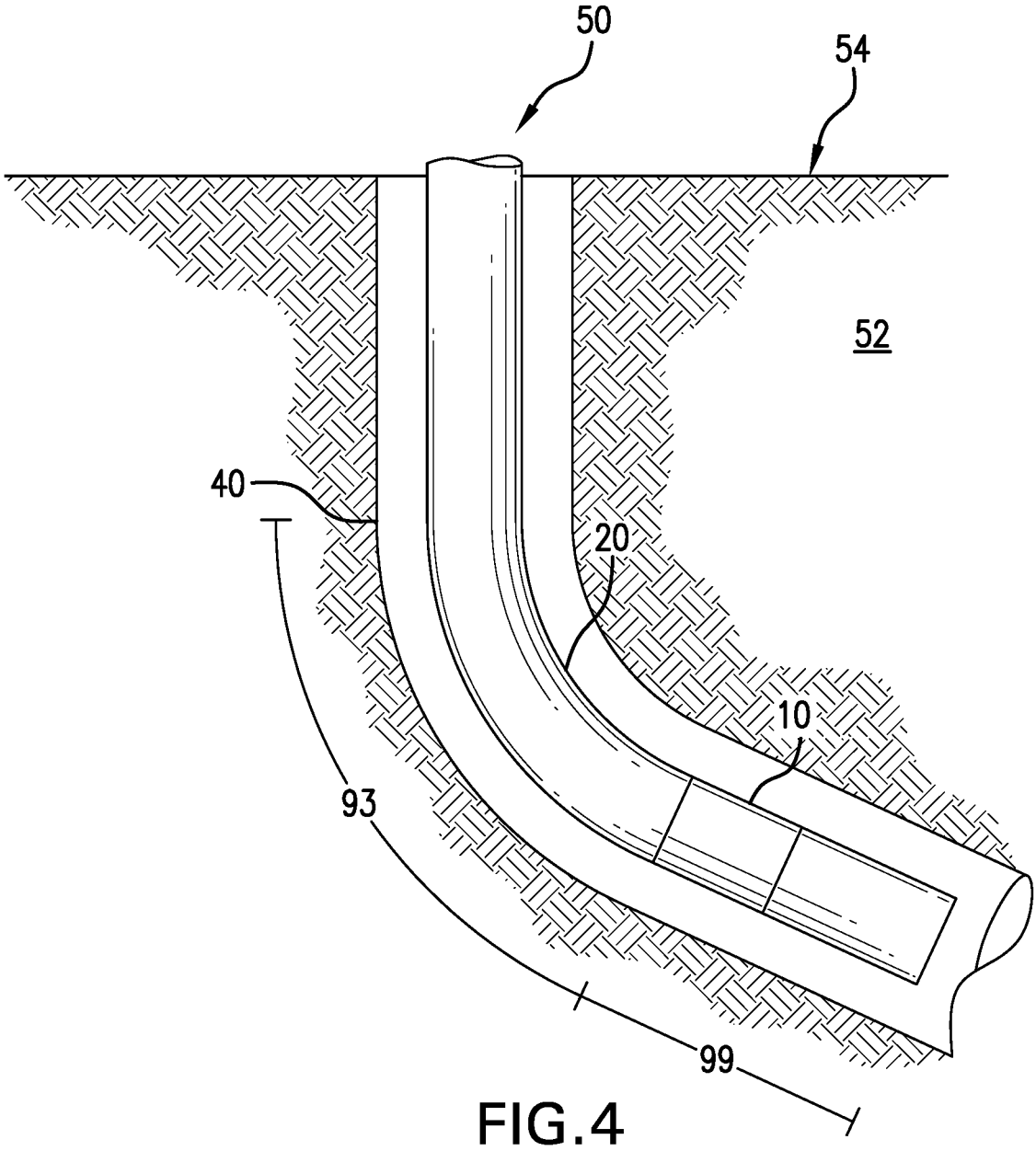
FIG. 4 is a view of a borehole system including the steering device as disclosed herein.

Referring to FIG. 4, a borehole system 50 comprises a borehole 40 in a subsurface formation 52. The borehole comprises a curved section 93 and a tangential or straight section 99. A drilling system or string 20 is disposed within the borehole 40. The string 20 may be a rotary steering string or a coiled tubing string in embodiments. The steering device 10 is disposed as a part of the string 20.

In use, the steering device 10 contributes to successful placement of the borehole 40 being drilled thereby by selectively unevenly distributing fluid toward a selected azimuthal direction relative to the formation, the earth's magnetic field and/or the direction of gravity and thereby causing a Bernoulli effect related steering force on the steering device 10.

Set forth below are some embodiments of the foregoing disclosure

Embodiment 1: A drilling system configured to drill a borehole into a subsurface formation, the drilling system including a steering device configured to be disposed in the borehole, the steering device rotatable within the borehole about a rotational axis of the steering device, the steering device configured to convey a fluid supply, a valve disposed in the steering device, at least a portion of the valve rotatable with the steering device about the rotational axis, the valve configured to allow fluid to flow through the valve from the fluid supply to an outside surface of the steering device, wherein the fluid flow causes a steering force on the steering device, the steering force configured to change a direction of drilling the borehole, and an actuator operably connected to the steering device and operatively connected to the valve, the actuator configured to operate the valve to change the fluid flow through the valve.

Embodiment 2: The drilling system as in any prior embodiment, wherein the valve is a first valve and the steering device comprises a second valve, the fluid flowing through the second valve from the fluid supply to the outside surface of the steering device, wherein the fluid flow through the second valve causes the steering force on the steering device, wherein the second valve is rotatable with the steering device.

Embodiment 3: The drilling system as in any prior embodiment, wherein the actuator is a first actuator operating the first valve and the steering device comprising a second actuator operating the second valve.

Embodiment 4: The drilling system as in any prior embodiment, wherein the actuator operates the first valve to change the fluid flow through the first valve and the second valve to change the fluid flow through the second valve.

Embodiment 5: The drilling system as in any prior embodiment, wherein the valve comprises a fluid passage and an obstruction member, and wherein the fluid passage and the obstruction member both rotate with the steering device.

Embodiment 6: The drilling system as in any prior embodiment, wherein the first valve and the second valve are individually actuatable to change the fluid flow through the first valve and the second valve.

Embodiment 7: The drilling system as in any prior embodiment, wherein the actuator rotates with the steering device about the rotational axis.

Embodiment 8: The drilling system as in any prior embodiment, wherein the valve is a reciprocating valve.

Embodiment 9: The drilling system as in any prior embodiment, wherein the steering force on the steering device caused by the fluid flow has a geostationary direction while the steering device is rotating about the rotational axis.

Embodiment 10: The drilling system as in any prior embodiment, wherein the fluid flows at the outside surface of the steering device along a plurality of channels that are separated by at least one barrier that has a radially extendable element.

Embodiment 11: A method for drilling a borehole into a subsurface formation, the method including disposing a steering device in the borehole, rotating the steering device within the borehole about a rotational axis, wherein the steering device configured to convey a fluid supply, wherein the steering device comprises a valve rotating with the steering device, and wherein the steering device further comprises an actuator operatively connected to the valve, urging a fluid to flow through the valve from the fluid supply to an outside surface of the steering device, wherein the fluid flow causes a steering force on the steering device, the steering force configured to change a direction of drilling the borehole, operating the valve by the actuator to change the fluid flow through the valve.

Embodiment 12: The method as in any prior embodiment, wherein the valve is a first valve and the steering device comprises a second valve, the method further comprising urging the fluid to flow through the second valve from the fluid supply to the outside surface of the steering device, wherein the fluid flow through the second valve causes the steering force on the steering device, wherein the second valve is rotatable with the steering device.

Embodiment 13: The method as in any prior embodiment, wherein the actuator is a first actuator operating the first valve and the steering device comprising a second actuator, the method further comprising operating the second valve by the second actuator to change the fluid flow through the second valve.

Embodiment 14: The method as in any prior embodiment, operating the second valve by the actuator to change the fluid flow through the second valve.

Embodiment 15: The method as in any prior embodiment, wherein the valve comprises a fluid passage and an obstruction member, and wherein the fluid passage and the obstruction member both rotate with the steering device.

Embodiment 16: The method as in any prior embodiment, further comprising actuating the first valve and the second valve individually to change the fluid flow through the first valve and the second valve.

Embodiment 17: The method as in any prior embodiment, wherein the actuator rotates with the steering device about the rotational axis.

Embodiment 18: The method as in any prior embodiment, wherein the valve is a reciprocating valve.

Embodiment 19: The method as in any prior embodiment, wherein the steering force on the steering device caused by the fluid flow has a geostationary direction while the steering device is rotating about the rotational axis.

Embodiment 20: The method as in any prior embodiment, wherein the fluid flows at the outside surface of the steering device along a plurality of channels that are separated by at least one barrier that has a radially extendable element.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A drilling system configured to drill a borehole into a subsurface formation, the drilling system comprising:

a steering device configured to be disposed in the borehole, the steering device rotatable within the borehole about a rotational axis of the steering device, the steering device configured to convey a fluid supply;

a valve disposed in the steering device, at least a portion of the valve rotatable with the steering device about the rotational axis, the valve configured to allow a fluid to flow through the valve from the fluid supply to an outside surface of the steering device at a selected azimuthal position about the rotational axis, wherein the fluid flows exits the steering device in an uphole direction from a flow channel and flows parallel to the rotational axis along the outside surface at the selected azimuthal position, thereby causing a reduction in pressure at the selected azimuthal position resulting in a steering force on the steering device that changes a direction of drilling of the borehole toward the selected azimuthal position; and an actuator operably connected to the steering device and operatively connected to the valve, the actuator configured to operate the valve to increase the fluid flow through the valve when the steering device is at a position for fluid to flow along the outside surface at the selected azimuthal position.

2. The drilling system as claimed in claim 1, wherein the valve is a first valve and the steering device comprises a second valve, the fluid flowing through the second valve from the fluid supply to the outside surface of the steering device, wherein the fluid flow through the second valve causes the steering force on the steering device, wherein the second valve is rotatable with the steering device.

3. The drilling system as claimed in claim 2, wherein the actuator is a first actuator operating the first valve and the steering device comprising a second actuator operating the second valve.

4. The drilling system as claimed in claim 2, further comprising a first flow passage for fluid flow from the first valve through a drill bit and a second flow passage for fluid flow from the second valve through the drill bit.

5. The drilling system as claimed in claim 1, wherein the valve comprises a fluid passage and an obstruction member, and wherein the fluid passage and the obstruction member both rotate with the steering device.

6. The drilling system as claimed in claim 2, wherein the first valve and the second valve are individually actuatable to change the fluid flow through the first valve and the second valve.

7. The drilling system as claimed in claim 1, wherein the actuator operates the valve to position the valve between fully open and fully closed to control a magnitude of the steering force at the selected azimuthal position.

8. The drilling system as claimed in claim 1, wherein the valve is a reciprocating valve.

9. The drilling system as claimed in claim 1, wherein the selected azimuthal position is a geostationary location and the fluid exits a drill bit in an uphole direction from a flow channel at the geostationary location.

10. The drilling system as claimed in claim 1, further comprising a flow barrier having a radially extendable element that extends radially to form a channel for fluid flow along the outside surface at the azimuthal position.

11. A method for drilling a borehole into a subsurface formation, the method comprising:

disposing a steering device in the borehole;

rotating the steering device within the borehole about a rotational axis;

wherein the steering device is configured to convey a fluid supply, wherein the steering device comprises a valve, at least a portion of the valve rotatable with the steering device about the rotational axis, and wherein the steering device further comprises an actuator operatively connected to the valve;

urging a fluid to flow through the valve from the fluid supply to an outside surface of the steering device at a selected azimuthal position about the rotational axis, wherein the fluid exits the steering device in an uphole direction from a flow channel and flows parallel to the rotational axis along the outside surface at the selected azimuthal position, thereby causing a reduction in pressure at the selected azimuthal position resulting a steering force on the steering device, the steering force configured to change a direction of drilling the borehole toward the selected azimuthal position;

operating the valve by the actuator to increase the fluid flow through the valve when the steering device is at a position for fluid to flow along the outside surface at the selected azimuthal position.

12. The method as claimed in claim 11, wherein the valve is a first valve and the steering device comprises a second valve, the method further comprising urging the fluid to flow through the second valve from the fluid supply to the outside surface of the steering device, wherein the fluid flow through the second valve causes the steering force on the steering device, wherein the second valve is rotatable with the steering device.

13. The method as claimed in claim 12, wherein the actuator is a first actuator operating the first valve and the steering device comprising a second actuator, the method further comprising operating the second valve by the second actuator to change the fluid flow through the second valve.

14. The method as claimed in claim 12, operating the second valve by the actuator to change the fluid flow through the second valve.

15. The method as claimed in claim 11, wherein the valve comprises a fluid passage and an obstruction member, and wherein the fluid passage and the obstruction member both rotate with the steering device.

16. The method as claimed in claim 12, further comprising actuating the first valve and the second valve individually to change the fluid flow through the first valve and the second valve.

17. The method as claimed in claim 11, wherein the actuator rotates with the steering device about the rotational axis.

18. The method as claimed in claim 11, wherein the valve is a reciprocating valve.

19. The method as claimed in claim 11, wherein the steering force on the steering device caused by the fluid flow has a geostationary direction while the steering device is rotating about the rotational axis.

20. The method as claimed in claim 11, further comprising extending an element radially from a flow barrier to form a channel for fluid flow along the outside surface at the azimuthal location.

21. The drilling system of claim 1, wherein the fluid flows from the valve to the drill bit via a flow passage, wherein a portion of the flow passage exits the drill bit at a face of the drill bit.

22. A drilling system configured to drill a borehole into a subsurface formation, the drilling system comprising:

a steering device configured to be disposed in the borehole, the steering device rotatable within the borehole about a rotational axis of the steering device, the steering device configured to convey a fluid supply;

a first valve disposed in the steering device, at least a portion of the first valve rotatable with the steering device about the rotational axis, the first valve configured to allow fluid to flow through the valve from the fluid supply to an outside surface of the steering device via a first flow passage, wherein the fluid flow through the first flow passage when the first flow passage is rotated to a selected azimuthal position with respect to the rotational axis, thereby causing a steering force on the steering device at the selected azimuthal position, the steering force configured to change a direction of drilling the borehole toward the selected azimuthal position; and a second valve disposed in the steering device, at least a portion of the second valve rotatable with the steering device about the rotational axis, the second valve configured to allow fluid to flow through the second valve from the fluid supply to an outside surface of the steering device via a second flow passage, wherein the fluid flow through the second flow passage when the second flow passage is rotated to the selected azimuthal position, thereby causing the steering force on the steering device at the selected azimuthal position, the steering force configured to change the direction of drilling the borehole toward the selected azimuthal position;

an first actuator operably connected to the steering device and operatively connected to the first valve, the first actuator configured to operate the first valve to change the fluid flow through the first valve; and a second actuator operably connected to the steering device and operatively connected to the second valve, the second actuator configured to operate the second valve to change the fluid flow through the second valve;

wherein the first actuator and the second actuator are operated to control the fluid flow, respectively, through the first valve and the second valve independently.

23. A drilling system configured to drill a borehole into a subsurface formation, the drilling system comprising:

a steering device configured to be disposed in the borehole, the steering device rotatable within the borehole about a rotational axis of the steering device, the steering device configured to convey a fluid supply;

a valve disposed in the steering device, at least a portion of the valve rotatable with the steering device about the rotational axis, the valve configured to allow fluid to flow through the valve from the fluid supply to an outside surface of the steering device, wherein the fluid flow causes a steering force on the steering device, the steering force configured to change a direction of drilling the borehole; and at least one member radially extendable from the steering device to form a channel for fluid flow along the outside surface at the azimuthal position;

an actuator operably connected to the steering device and operatively connected to the valve, the actuator configured to operate the valve to change the fluid flow through the valve.

* * * * *